US006119565A

United States Patent [19]

L'Heureux

[11] Patent Number: 6,119,565

[45] Date of Patent: Sep. 19, 2000

[54] APPARATUS AND METHOD FOR ELECTRONICALLY MEASURING AND CUTTING FLOOR COVERINGS

[75] Inventor: Jere M. L'Heureux, 1152 Lochmoor Blvd., Grosse Pointe Woods, Mich. 48236

[73] Assignee: Jere M. L'Heureux, Grosse Pointe Woods, Mich.

[21] Appl. No.: 08/874,937

[22] Filed: Jun. 13, 1997

[51] Int. Cl.[7] ..... B26D 5/00

[52] U.S. Cl. ..... 83/13; 83/76.9; 83/76.6

[58] Field of Search ..... 83/56, 365, 368, 83/370, 13, 76.6, 76.7, 361, 363, 364, 369, 371, 62.1, 522.13, 522.17, 522.18, 522.19, 949; 342/463, 465, 387, 450, 457, 458; 702/158, 159, 168, 155, 156, 157, 161; 364/474.37, 474.09, 468.24; 455/67.6; 33/706–708, 526–527; 356/3

[56] References Cited

U.S. PATENT DOCUMENTS

| | | | |
|---|---|---|---|
| 3,199,104 | 8/1965 | Miller | 702/158 |
| 3,477,322 | 11/1969 | Gerber et al. . | |
| 3,683,731 | 8/1972 | Oppenheim et al. . | |
| 3,710,083 | 1/1973 | Hoeff | 702/158 |
| 3,776,072 | 12/1973 | Gerber et al. . | |
| 3,803,960 | 4/1974 | Pearl et al. | 83/56 |
| 3,805,650 | 4/1974 | Pearl . | |
| 3,877,332 | 4/1975 | Roch . | |
| 3,895,358 | 7/1975 | Pearl . | |
| 4,178,820 | 12/1979 | Gerber . | |
| 4,375,175 | 3/1983 | Elsas | 83/368 |
| 4,438,754 | 3/1984 | Nanny et al. | 83/368 |
| 4,470,122 | 9/1984 | Sarr | 364/559 |
| 4,551,810 | 11/1985 | Levine . | |
| 4,554,635 | 11/1985 | Levine . | |
| 4,709,483 | 12/1987 | Hembree et al. . | |
| 4,730,526 | 3/1988 | Pearl et al. . | |
| 4,739,487 | 4/1988 | Bonnet et al. . | |
| 4,793,033 | 12/1988 | Schneider et al. | 83/62.1 |
| 4,866,630 | 9/1989 | Beaman et al. . | |
| 4,901,359 | 2/1990 | Bruder | 83/56 |
| 4,905,512 | 3/1990 | Hayashi | 702/156 |
| 5,091,869 | 2/1992 | Ingram et al. | 702/155 |
| 5,188,009 | 2/1993 | Sunohara et al. . | |
| 5,251,142 | 10/1993 | Cramer . | |
| 5,365,812 | 11/1994 | Harnden . | |
| 5,414,617 | 5/1995 | Pomerleau et al. . | |
| 5,418,729 | 5/1995 | Holmes et al. . | |
| 5,428,548 | 6/1995 | Pilborough et al. | 364/474.37 |
| 5,450,615 | 9/1995 | Fortune et al. | 455/67.6 |
| 5,528,517 | 6/1996 | Loken | 702/156 |
| 5,589,838 | 12/1996 | McEwan | 342/463 |
| 5,600,330 | 2/1997 | Blood | 342/463 |
| 5,650,949 | 7/1997 | Kishimoto | 702/155 |
| 5,737,244 | 4/1998 | Ruck | 364/474.37 |
| 5,754,703 | 5/1998 | Kim | 364/474.37 |
| 5,787,017 | 7/1998 | Hearing | 702/155 |
| 5,790,076 | 8/1998 | Sypniewski | 342/465 |

*Primary Examiner*—Rinaldi I. Rada
*Assistant Examiner*—Kim Ngoc Tran
*Attorney, Agent, or Firm*—Harness, Dickey & Pierce, P.L.C.

[57] ABSTRACT

An apparatus and method for electronically measuring a floor space area into which a floor covering is to be installed. A stylus is traced around the periphery of the floor space. The stylus emits signals which a controller decodes into electronic measurement data. The electronic measurement data is stored in memory. Data stored in memory is then transferred to an electronic cutting unit which uses the measurement data to generate commands for controlling a cutting tool to cut the floor covering to a predetermined size.

11 Claims, 2 Drawing Sheets

APPARATUS AND METHOD FOR ELECTRONICALLY MEASURING AND CUTTING FLOOR COVERINGS

TECHNICAL DESCRIPTION

This invention relates generally to an apparatus and method for electronically cutting floor covering for installation, and, more particularly, to an apparatus and method for electronically measuring a predefined area into which the floor covering will be installed and using the electronically obtained measurements as input to a cutting tool to accurately cut the floor covering, thereby minimizing installation time.

BACKGROUND OF THE INVENTION

The floor covering industry has seen many improvements in the variety and quality of floor covering products. Unfortunately, the methods of installation have failed to keep pace with advances in the variety and quality of the available floor coverings. In particular, installation of floor covering still occurs using tools and methods that originated many, many years ago and have remained unchanged and relatively unimproved.

In a typical floor covering installation project, installers use tape measures to measure the area in which the floor covering will be installed. In doing so, the installer may jot down a few measurements onto a piece of paper for later use when measuring the floor covering. The installer then lays out the floor covering and attempts to transform the tape measurements recorded on paper to the floor covering. The installer then uses a knife, such as a hook blade or utility knife, to cut the floor covering to an approximate shape of the area where the floor covering will be installed. The installer then places the floor covering into the area and trims the floor covering in order to obtain a suitable fit. The floor covering is then fixed in place using an adhesive, tack, strip, or staple.

The age old method of installing floor covering significantly limits the number and complexity of installations which an installation team can perform in a given time period. The time required to measure, cut, trim, and fix in place can only be reduced by so much using these age old methods.

Further complicating the situation, the present number of floor covering installers cannot keep up with the number of installations, and a significant backlog often develops within the floor covering industry. The backlog results not because of availability of product, but because of the availability of capable, competent installers. Further yet, the competition for skilled tradesman continues to increase, and the availability of apprentices and journeyman desiring to go into the floor covering installation trade has steadily decreased. These trends combine to significantly limit the number of installations which can be performed.

Thus, it is an object of the present invention to provide an apparatus and method for significantly reducing the manual labor required for installing floor covering.

It is a further object of the present invention to provide an apparatus and method for electronically measuring the area into which floor covering will be installed and cutting the floor covering to the desired size to fill the area.

It is yet a further object of the present invention to provide an electronic apparatus for measuring the area of the room into which the floor covering will be installed.

It is yet a further object of the present invention to include with the electronic measuring apparatus memory for storing the measurement data so that the measurement data may be transported for input into an electronic cutting unit.

It is yet a further object of the present invention to provide an apparatus and method for measuring and cutting floor covering in accordance with the measurement data obtained electronically by providing a cutting apparatus which reads the electronic measurement data from memory and electronically controls a cutting tool to cut the floor covering to a predetermined shape.

SUMMARY OF THE INVENTION

The present invention is directed to an apparatus for cutting a sheet material to fit a predefined area. The apparatus includes an electronic measuring device for traversing the predefined area for which the sheet material is to be fit. The measuring device outputs measurement data for the area to be fit. Memory stores the measurement data output by the electronic measuring device. An electronic cutting device receives measurement data stored in the memory, and the cutting device includes a cutting tool for cutting the sheet material. The cutting tool is displaced in accordance with the measurement data.

The present invention is also directed to a method for installing a floor covering material including the following steps. Electronically measuring a floor space into which the floor covering is to be installed, thereby providing electronic measurement data. Storing the electronic measurement data in memory. Transferring the electronic measurement data from memory to an electronic cutting machine, where the electronic cutting machine cuts the floor covering material in accordance with the electronic measurement data.

Additional objects, features and advantages of the present invention will become apparent from the following description and the appended claims, taken in connection with the accompanying drawings.

DETAILED DESCRIPTION OF THE INVENTION

Figure 1:
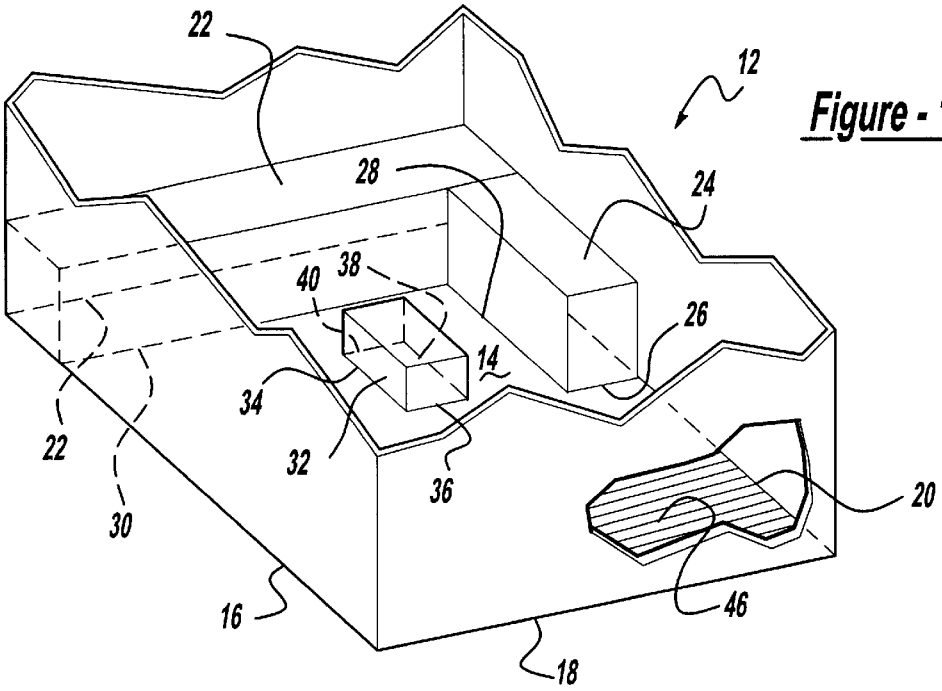
FIG. 1 is a cutaway, perspective view of a room to be electronically measured and into which floor covering will be cut and installed in accordance with the teachings of the present invention.

FIG. 1 depicts a cutaway, perspective view of a room 12 having a floor space 14 defined by left edge 16, bottom edge 18, right edge 20 and top edge 22. Floor space 14 of room 12 is not a complete rectangular or square area, as room 12 includes top counter 23 and right counter 24. The counters 23 and 24 create a resultant three additional edges defined by short edge 26, right partial edge 28, and top partial edge 30. Further, room 12 is also shown having an island 32 creating a cutout having four additional edges 34, 36, 38, and 40.

Figure 2:
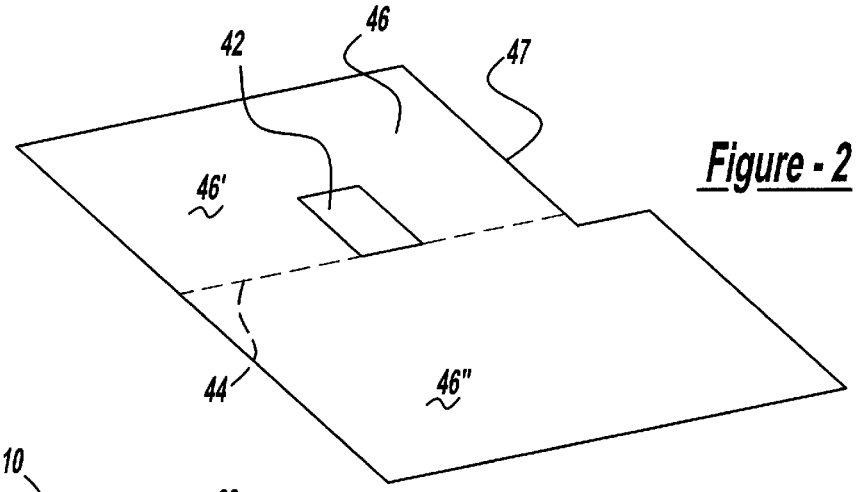
FIG. 2 is a perspective view of the floor covering cut in accordance with electronic measurement data based on the dimensions of the room of FIG. 1.

The combined edges 16, 18, 20, and 22, counters 23 and 24, and island 32 provide a floor space 14 which requires a floor covering to be cut as shown by floor covering 46 in FIG. 2. Floor covering 46 includes an outer periphery 47 which matches the floor space 14 of FIG. 1. The floor covering 46 also includes a cutout 42 to accommodate the island 32. Further, floor covering 46 comprised of two separate panels or sheets of floor coverings 46' and 46" which are joined along a seam 44.

Figure 3:
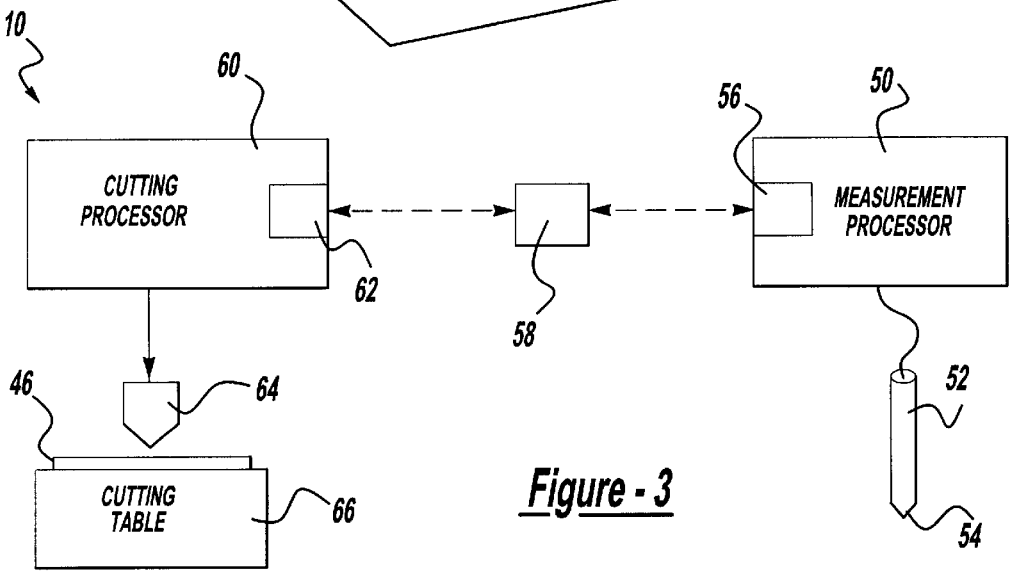
FIG. 3 is a block diagram of the electronic measuring system arranged in accordance with the principles of the present invention.

FIG. 3 depicts a block diagram of the electronic measurement and cutting system 10 arranged in accordance with the principles of the present invention. The system includes a measurement processor 50 which electronically communicates with a wand or stylus 52 having a tip 54. An operator (not shown) manually traces the periphery of floor space 14 to be covered in order to determine the desired measurement of the floor covering 46 of FIG. 2. Stylus 52 traces the periphery of floor space 14 as stylus 50 traverses the room along, for example, right edge 20, short edge 26, right partial edge 28, top partial edge 30, left edge 16, and bottom edge 18. Further, the tip 54 of wand 52 preferably also trace edges 34, 36, 38, and 40 to define the cutout 42 in the floor covering 46.

Electronic measurement processor 50 receives electronic measurement signals from wand 52 and stores the measurement data in a memory 56. The memory 56 may comprise a memory media, such as Random Access Memory (RAM), non-volatile memory, or a hard disk, or the like. Alternatively, memory 56 may also include a portable memory media 58, such as a computer diskette, a CD-ROM, a ZIP drive, or the like. Portable memory media 58 may be removed from the measurement processor 50 after the relevant measurement data has been written thereon and transported to a cutting processor 60. Cutting processor 60 includes a read/write device 62, preferably compatible with the portable memory media 58 so that electronic measurement data may be input to cutting processor 60. Alternatively, one skilled in the art may recognize that various method of transferring data from memory 56, or directly from measurement processor 50, to memory 62 of cutting processor 60 may be equally acceptable. For example, measurement processor 50 may have an input/output port which communicates with a matching input/output port of cutting processor 60 so that data may be directly downloaded via a hardwire. Other options for enabling communication between measurement processor 50 and cutting processor 60 include radio frequency (RF) or modem based communication.

Cutting processor 60 decodes the measurement data into instructions for displacing and operating a cutting tool 64. Cutting processor 60 generates commands which displace cutting tool 64 to a starting position and activates cutting tool 64 in order to begin cutting floor covering 46. Cutting processor 60 further generates commands to displace cutting tool 64 while in a cutting mode in order to cut the predetermined and desired shapes into floor covering 46. Floor covering 46 is typically placed and fixed onto a cutting table 66 so that either the cutting tool 64 moves while the cutting table and floor covering 46 remain fixed, or the floor covering 46 is displaced on the cutting table while the cutting tool 64 remains fixed.

Figure 4:
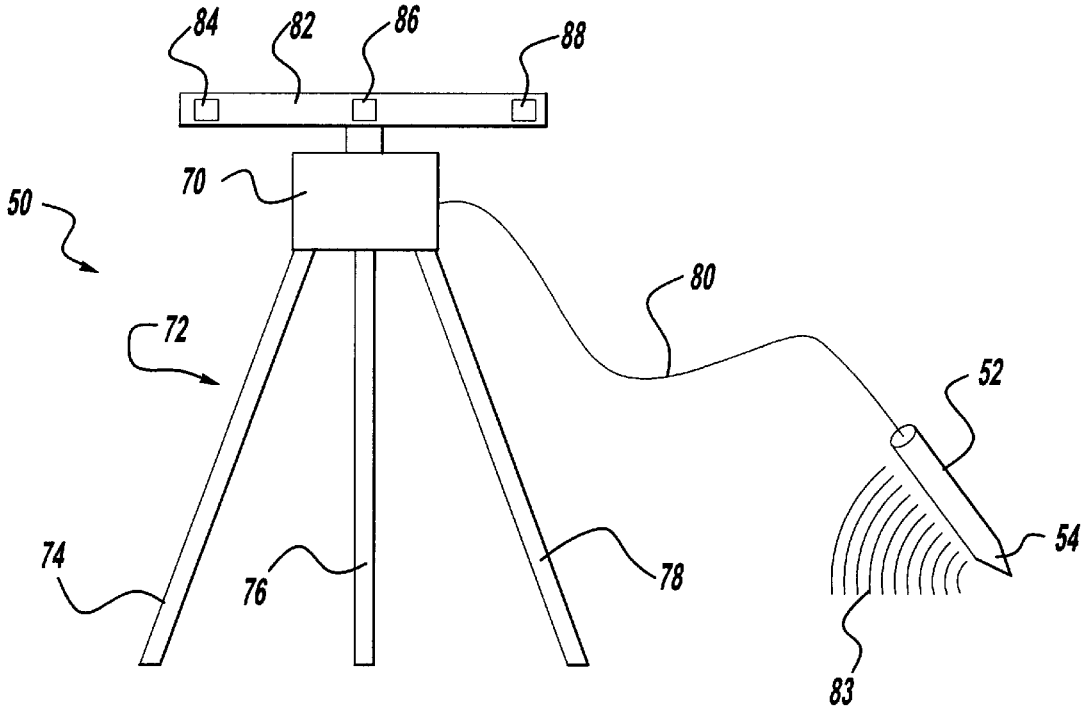
FIG. 4 is a measurement processor and measurement wand for electronically measuring a room.

FIG. 4 depicts one embodiment of measurement processor 50. Measurement processor 50 includes a processor 70 supported upon a tripod 72 having three legs 74, 76, and 78. Processor 70 communicates with wand or stylus 52 via a signal line 80. Signal line 80 provides power to wand or stylus 52, as will be described further herein. Processor 70 receives signal input from detector 82, which has a plurality of sensors 84, 86, and 88. In one particular embodiment, wand 52 generates an electromagnetic output signal 83 from tip 54. Sensors 84, 86, and 88 detect electromagnetic signal 83. Processor 70 determines the time differential between detection of electromagnetic signal 83, sensors 84 and 86 and triangulates the position of the tip 54 of the stylus 52. By taking a continuous series of measurements in this manner, a series of X-Y coordinates defining the location of tip 54 relative to processor 70 can be determined. Processor 70 may translate these coordinates directly into dimensional measurements for floor covering 46, or may store the X-Y data for conversion into the measurements of floor covering 46 by the cutting processor 60.

One skilled in the art will readily recognize that one of several configurations may be implemented for the processor 70, particularly with respect to interaction between the wand or stylus 52 and processor 70. For example, electromagnetic signal 83 emitted from in proximity to tip 54 may be a radio frequency (RF) signal. If electromagnetic signal 83 is an RF signal, sensors 84, 86, and 88 are correspondingly configured to detect RF emissions. Sensors 84, 86, and 88 are tuned to the particular frequency of electromagnetic signal 83. Alternatively, stylus 52 may emit an electromagnetic signal 83 in the form of a light emission, such as may be emitted by a light emitting diode (LED). If electromagnetic signal 83 is a light-based signal, sensors 84, 86, and 88 are correspondingly configured to detect emissions of light and are further configured to detect light in the particular frequency range of the electromagnetic signal emitted from in proximity to tip 54 of stylus 52.

Figure 5:
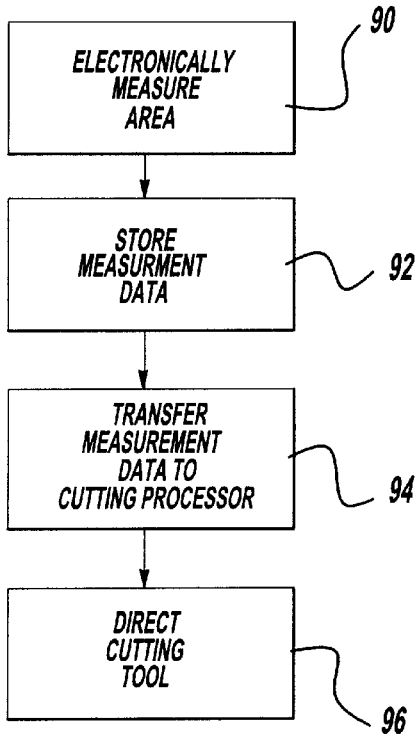
FIG. 5 is a block diagram of a method for implementing the method of installing floor covering.

FIG. 5 depicts a block diagram for the method of measuring and cutting floor covering. As shown in block 90, the installer first electronically measures area 14 into which floor covering 46 is to be installed. As described with respect to FIGS. 3 and 4, obtaining electronic measurement data comprises tracing the periphery of the area 14 with tip 54 of stylus or wand 52. Electronically measuring floor space 14 generates measurement data which is stored as shown at step 92 in measurement processor 50. As shown in block 94, the stored measurement data is then transferred to the cutting processor, such as cutting processor 60 of FIG. 3. Cutting processor 60 interprets the measurement data in preparation for directing cutting tool 64 to cut the floor covering 46. As shown at block 96, cutting tool 64 is directed in accordance with the measurement data in order to effect cutting of the floor covering.

As can be seen from the foregoing, the present invention significantly reduces the time required to install floor covering by eliminating the manual process of measuring, cutting and then continuously adjusting the floor covering in order to effect a sound installation. Further, one can see that by electronically measuring and cutting floor covering, use of floor covering can be maximized as the cutting processor could determine cuts for several rooms from one roll of floor covering in order to optimize use of the available floor covering. This significantly reduces the material required over several installations. Further, one skilled in the art will recognize that the above-described method and apparatus is equally applicable to any sheet material which is cut and installed to fit a predetermined area.

While the above detailed description describes the preferred embodiment of the present invention, it should be understood that the present invention is susceptible to modification, variation and alteration without deviating from the scope and fair meaning of the subjoined claims.

What is claimed is:

1. An apparatus for cutting a floor covering material to fit a predefined floor space, comprising:

a processing unit;

a hand-held measurement wand for traversing the predefined floor space to be measured and transmitting electronic signals to the processing unit, the electronic signals defining measurement data characterizing the floor space, wherein the processing unit transforms the electronic signals into a length traversed by the measurement wand;

memory for storing the measurement data output by the processing unit and an electronic cutting device connected to and receiving the measurement data for the floor space stored in the memory, the cutting device including a cutting tool for cutting the floor covering material, the cutting tool being displaced in accordance with the measurement data.

2. The apparatus of claim 1 wherein the memory comprises a portable media which may be removed from the processing unit for attachment and interaction with the electronic cutting device.

3. The apparatus of claim 1 wherein the measurement wand communicates with the processing unit via a radio frequency signal.

4. The apparatus of claim 3 wherein the processing unit further comprises a plurality of RF sensors which detect the RF signal transmitted by the measurement wand and wherein the processing unit determines the position of the measurement wand by triangulating the RF signal detected by the RF sensors.

5. The apparatus of claim 1 wherein the measurement wand communicates with the processing unit via transmission of a light signal.

6. The apparatus of claim 5 wherein the processing unit further comprises a plurality of optical sensors which detect the light signal transmitted by the measurement wand and wherein the processing unit determines the position of the measurement wand by triangulating the light signal detected by the optical sensors.

7. A method for measuring and cutting a floor covering material for a floor space, comprising the steps of:

tracing an area defined by a periphery of the floor space in which the floor covering is to be installed with a wand, the wand generating electronic signals which define measurement data characterizing the floor space;

storing the electronic measurement data in memory; and transferring the electronic measurement data from memory to an electronic cutting machine, the electronic cutting machine cutting the floor covering material in accordance with the electronic measurement data.

8. The method of claim 7 wherein the step of transferring the electronic measurement data from memory further comprises storing the measurement data onto a portable storage media and transferring the portable media to the cutting machine.

9. The method of claim 7 wherein the cutting machine further comprises a cutting tool and further comprising the step of directing a cutting tool in accordance with the electronic measurement data in order to cut the floor covering.

10. An apparatus for measuring a defined floor space and for cutting a floor covering material to fit the floor space, the floor space including a periphery and optionally having an internal border around which the floor covering is installed, comprising:

a processing unit having a plurality of electromagnetic sensors; and a measurement wand for traversing the periphery and optional internal border to be measured and communicating electronic signals to the processing unit, the electronic signals defining measurement data characterizing the floor space, the measurement wand communicating with the processing unit wirelessly by transmitting electromagnetic signals detected by electromagnetic sensors, wherein the processing unit determines the position of the wand by triangulating the electromagnetic signals detected by the electromagnetic sensors and transforms the electronic signals into measurement data defining a length traversed by the measurement wand;

memory for storing the measurement data output by the processing unit; and an electronic cutting device connected to and receiving the measurement data stored in the memory, the cutting device including a cutting tool for cutting the floor covering material, the cutting tool being displaced in accordance with the measurement data, the floor covering being cut in accordance with the dimensions of the periphery and the internal border.

11. The apparatus of claim 10 wherein the memory comprises a portable media which may be removed from the processing unit for attachment and interaction with the electronic cutting device.

* * * * *